US005647145A

United States Patent [19]

Russell et al.

[11] Patent Number: 5,647,145

[45] Date of Patent: Jul. 15, 1997

[54] SCULPTURED ATHLETIC FOOTWEAR SOLE CONSTRUCTION

[76] Inventors: Brian Russell, 7869 S. Independence Way, Littleton, Colo. 80123; Danny Abshire, 633D S. Broadway, Boulder, Colo. 80303

[21] Appl. No.: 461,132

[22] Filed: Jun. 5, 1995

[51] Int. Cl.[6] ..... A43B 13/18; A43B 13/00; A43B 13/14

[52] U.S. Cl. ..... 36/28; 36/25 R; 36/31

[58] Field of Search ..... 36/28, 25 R, 31, 36/32 R, 30 R, 76 C, 76 R, 103, 114, 59 C

[56] References Cited

U.S. PATENT DOCUMENTS

| | | | |
|---|---|---|---|
| Re. 33,066 | 9/1989 | Stubblefield | 36/83 |
| D. 321,975 | 12/1991 | Arnulf et al. | D2/320 |
| D. 326,956 | 6/1992 | Damianoe et al. | D2/320 |
| D. 331,832 | 12/1992 | Issler | D2/320 |
| D. 343,272 | 1/1994 | James | D2/953 |
| D. 347,105 | 5/1994 | Johnson | D2/952 |
| 2,811,791 | 11/1957 | Cox | 36/76 R |
| 3,086,532 | 4/1963 | Mistarz | 36/32 R X |
| 3,100,354 | 8/1963 | Lombard et al. | 36/25 |
| 3,290,801 | 12/1966 | Bente | 36/2.5 |
| 3,402,485 | 9/1968 | McMorrow | 36/25 |
| 4,259,792 | 4/1981 | Halberstadt | 36/28 |
| 4,266,349 | 5/1981 | Schmohl | 36/32 R |
| 4,335,530 | 6/1982 | Stubblefield | 36/83 |
| 4,372,058 | 2/1983 | Stubblefield | 36/32 R |
| 4,922,631 | 5/1990 | Anderié | 36/76 R X |
| 5,005,299 | 4/1991 | Whatley | 36/25 R |
| 5,311,680 | 5/1994 | Comparetto | 36/154 |
| 5,319,866 | 6/1994 | Foley et al. | 36/31 X |
| 5,367,791 | 11/1994 | Gross et al. | 36/31 |
| 5,384,973 | 1/1995 | Lyden | 36/25 R |
| 5,440,826 | 8/1995 | Whatley | 36/25 R |
| 5,465,507 | 11/1995 | Schumacher et al. | 36/30 R |

*Primary Examiner*—B. Dayoan
*Attorney, Agent, or Firm*—John R. Flanagan

[57] ABSTRACT

A sculptured sole for athletic footwear includes a base having a plurality of forward support pads which underlie the toes of a wearer's foot and a plurality of rearward support lands which underlie the metatarsals in the ball area of the wearer's foot, a layer of flexible resilient elastic material attached on either of the opposite top or bottom sides of the base and aligned with the forward support pads and rearward support lands, and a plurality of plates and caps which are attached to the layer of elastic material and aligned with the respective support pads and support lands. The support pads and support lands in the pluralities thereof are isolated from one another by respective pluralities of grooves and channels whereas the support lands are isolated from the support pads by an arcuate depression which extends across the width of the base such that the support pads and lands undergo compression and rebound, as the layer stores and releases energy, substantially in response to respective forces applied thereto and lifted therefrom by the toes and metatarsals of the foot. Also, the sole includes a heel member defining a longitudinal concavity open at an inclined beveled rear surface on the heel member and extending between opposite side support sections compressible into the concavity to absorb shock to the wearer's heel.

25 Claims, 5 Drawing Sheets

SCULPTURED ATHLETIC FOOTWEAR SOLE CONSTRUCTION

BACKGROUND OF THE INVENTION

1. Field of the Invention

The present invention generally relates to shoes and, more particularly, is concerned with a sculptured sole construction for athletic footwear.

2. Description of the Prior Art

The increasing popularity of athletic endeavors has been accompanied by an increasing number of shoe designs intended to meet the needs of the participants in the various sports. The proliferation of shoe designs has especially occurred for the participants in athletic endeavors involving walking and running. In typical walking and running gaits, it is well understood that one foot is always on the ground in a "stance mode" while the other foot is moving through the air in a "swing mode". Furthermore, in the stance mode, the respective foot "on the ground" travels through three successive basic phases: heel strike, mid stance and toe off. At faster running paces, the heel strike phase is usually omitted.

Current shoe designs fail to adequately address the needs of the participant's foot and ankle system during each of these successive stages. Current shoe designs cause the participant's foot and ankle system to lose a significant proportion, by some estimates at least thirty percent, of its functional abilities including its abilities to absorb shock, load musculature and tendon systems, and to propel the runner's body forward. This is because the soles of current walking and running shoe designs fail to address individually the heel, toes, tarsels, muscles and tendons of a participant's foot. The failure to individually address these foot components inhibits the flexibility of the foot and ankle system, interferes with the timing necessary to optimally load the foot and ankle system, and interrupts the smooth and continuous transfer of energy from the heel to the toes of the foot during the three successive basic phases of the "on the ground" foot travel.

Consequently, a need remains for athletic footwear having a sole construction that individually addresses the actions of the heel, toes, metatarsels, muscles and tendons of a participant's foot.

SUMMARY OF THE INVENTION

The present invention provides athletic footwear having a sculptured sole construction designed to satisfy the aforementioned needs by avoiding the drawbacks of the prior art without introducing other drawbacks. The sculptured sole construction of the present invention is adapted to replace the sole of conventional athletic footwear, especially walking and running shoes, so as to improve and enhance the performance thereof by providing a structure which complements and augments, rather than one that opposes and inhibits, the natural flexing actions of the muscles of the heel, metatarsels and toes of the foot. The features of the sculptured sole construction provide unique control over and guidance of the energy of the foot as it travels through the three successive basic phases of heel strike, mid stance and toe off.

Accordingly, the present invention is directed to a sculptured footwear sole for use in construction of a shoe, particularly athletic footwear. The sculptured sole comprises a base of resiliently compressible material having opposite top and bottom sides and opposite forward and rearward edges, and a plurality of forward support pads defined on the bottom side of the base so as to extend downwardly therefrom and rearwardly from the forward edge thereof so that each forward support pad underlies only one of the toes of a wearer's foot disposed above the sole. The sole also comprises a plurality of slots defined in the bottom side of the base such that each slot is formed centrally of one of the forward support pads so as to extend generally in alignment with the respective one toe that the one forward support pad underlies so that a force applied to the one forward support pad by the respective one toe is directed toward the respective slot centrally formed therein. The sole also comprises a plurality of grooves defined in the bottom side of the base such that the grooves are formed between and space apart adjacent ones of the respective forward support pads and extend generally in alignment with respective gaps between the toes of the foot so as to isolate the forward support pads from one another so that each forward support pad undergoes compression and rebound substantially in response to the force applied thereto and lifted therefrom only by the respective one of the toes of the foot.

The sculptured sole further comprises a plurality of rearward support lands defined on the bottom side of the base so as to extend downwardly therefrom and be rearwardly spaced from the forward support pads and forward edge of the base such that each rearward support land underlies a respective one of the metatarsels of the wearer's foot disposed above the sole. The sole also comprises a plurality of channels defined in the bottom side of the base such that the channels are formed between and space apart adjacent ones of the rearward support lands and extend generally in alignment with respective gaps between the metatarsels of the foot and isolate the rearward support lands from one another so that each rearward support land undergoes compression and rebound substantially in response to the force applied thereto and lifted therefrom only by the respective one of the metatarsels of the foot.

The sculptured sole of the present invention further comprises a layer of resiliently elastic material attached to one of the top and bottom sides of the base. The layer has a main portion extending generally in alignment with the rearward support lands, and a plurality of edge portions extending forwardly from the main portion. Edge portion extends generally coextensive and aligned with one of the forward support pads of the base and with the slot formed centrally of the one support pad. The layer also has a plurality of openings formed through the main portion, extending generally in alignment with the grooves in the base and between and spacing apart adjacent ones of the edge portions of the layer such that each edge portion is isolated from one another so as to stretch and store energy as the aligned one forward support pad undergoes compression and to contract and release energy as the one forward support pad undergoes rebound substantially in response to the force applied thereto and lifted therefrom only by the respective one of the toes of the foot. The holes formed through the main portion extend generally in alignment with and are disposed forwardly of forward ends of the support lands such that the main portion of the layer is adapted to stretch and store energy as the rearward support lands undergo compression and to contract and release energy as the rearward support lands undergo rebound substantially in response to the force applied thereto and lifted therefrom by respective ones of the metatrasals of the foot.

Still further, the sculptured sole comprises a plurality of plates made of a flexible inelastic material. Each plate is spaced apart from one another and attached on the layer of resiliently elastic material and disposed generally in alignment with a respective one of the forward support pads of the base. A plurality of webs made of flexible inelastic material extends between and interconnects adjacent ones of the plates.

Yet further, the sculptured sole comprises a plurality of caps made of a flexible inelastic material. Each cap is spaced apart from one another and attached on the layer of resiliently elastic material and spaced rearwardly from a respective one of the plates and disposed generally in alignment with a respective one of the rearward support lands of the base. A plurality of webs made of flexible inelastic material extends between and interconnects adjacent ones of the caps.

The sculptured sole of the present invention further comprises a heel member made of a resiliently compressible material and attached to the base and extending rearwardly therefrom. The heel member includes a rear end section defining a transversely-extending rearwardly and upwardly inclined rear bevel surface, and a pair of opposite side support sections merging with and extending forwardly from the rear end section and defining therewith a longitudinal concavity open at a rear end through the rear bevel surface and extending forwardly between the opposite side support sections so as to direct forces of compression and rebound into the concavity and thereby provide improved stability for and absorption of shock to a heel of the wearer's foot.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
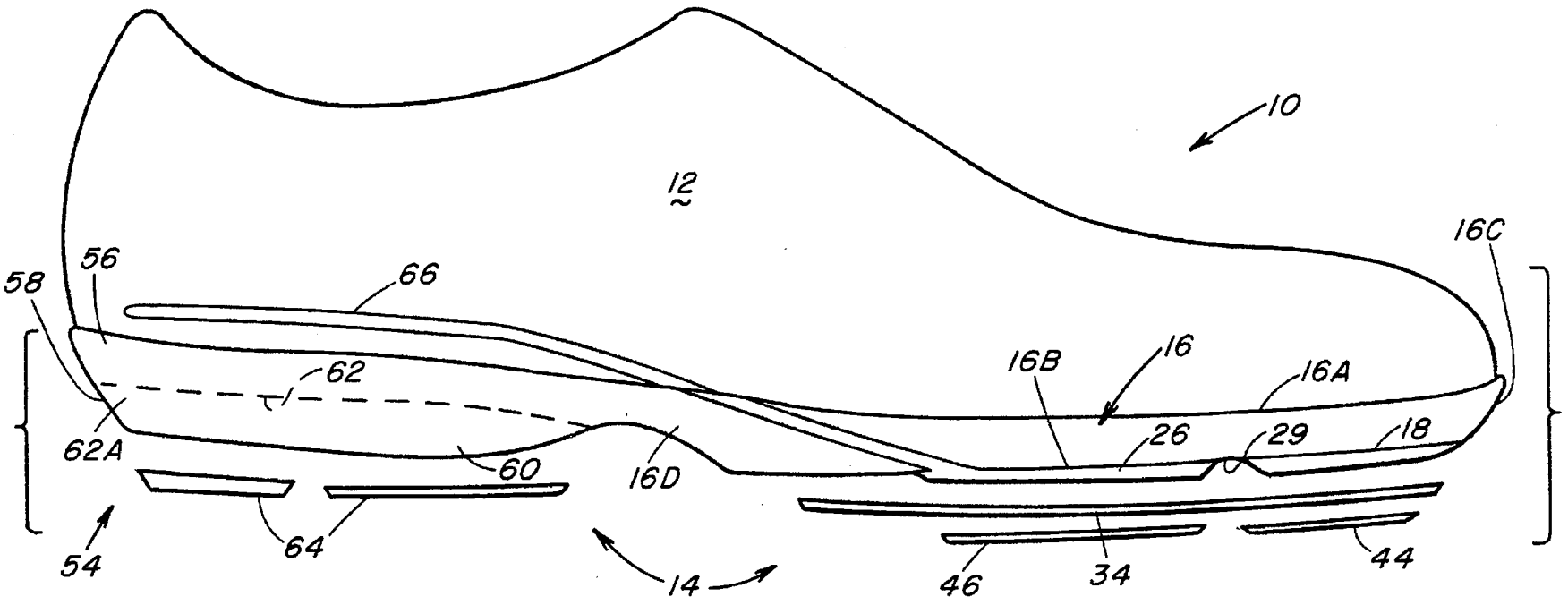
FIG. 1 is an exploded side elevational view of an article of athletic footwear incorporating a sculptured sole of the present invention.

Referring to the drawings and particularly to FIG. 1, there is illustrated an article of athletic footwear, such as a walking or running shoe, generally designated 10, having an upper 12 and incorporating the sculptured sole 14 of the present invention. The sculptured sole 14, whose parts are depicted in exploded form, improves the performance of the shoe 10 by providing a structure which complements and augments the natural flexing actions of the muscles of the heel, metatarsals and toes of the foot.

Figure 2:
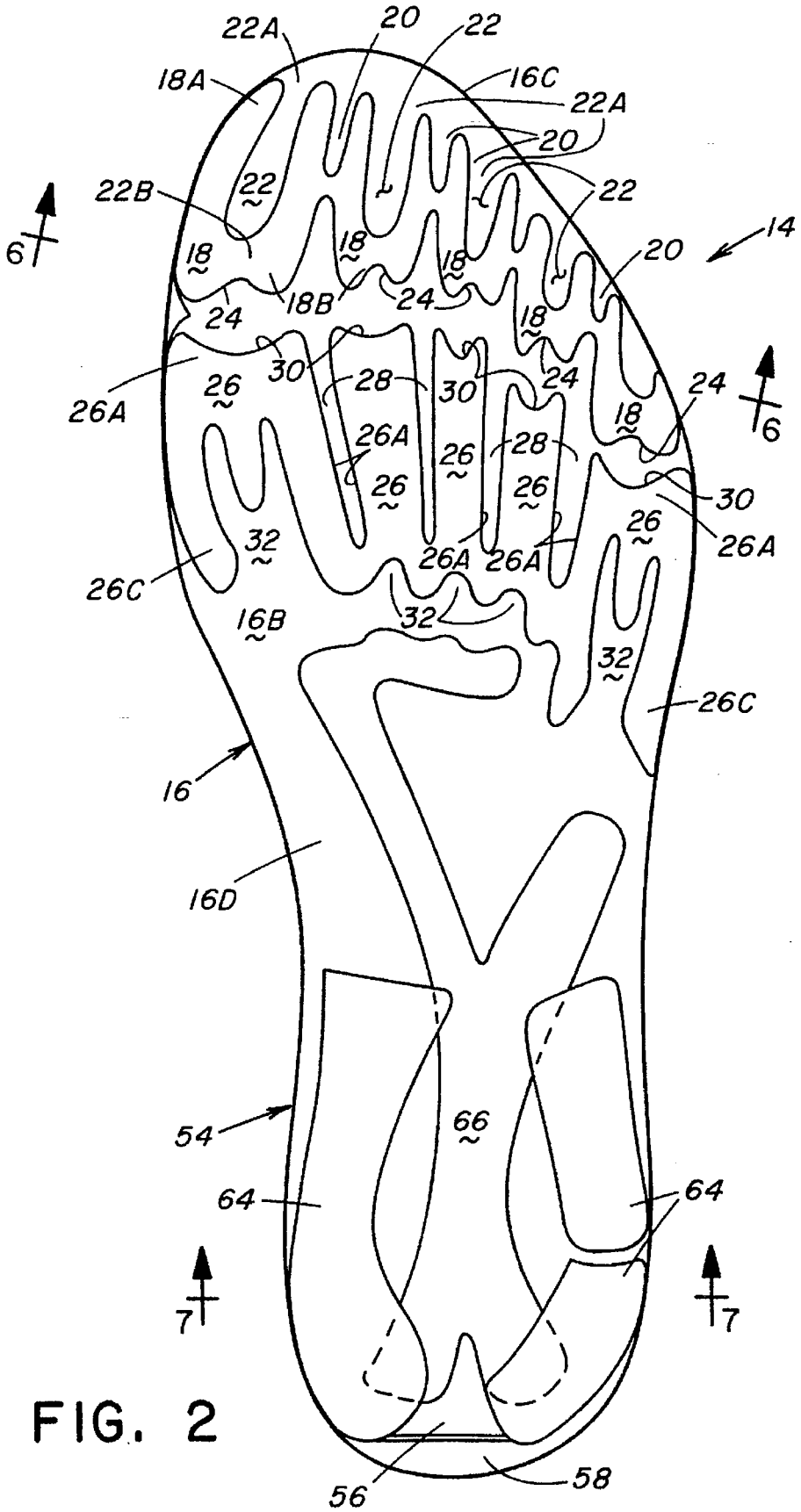
FIG. 2 is a bottom plan view of the base and heel member of the sculptured sole of FIG. 1.
Figure 3:
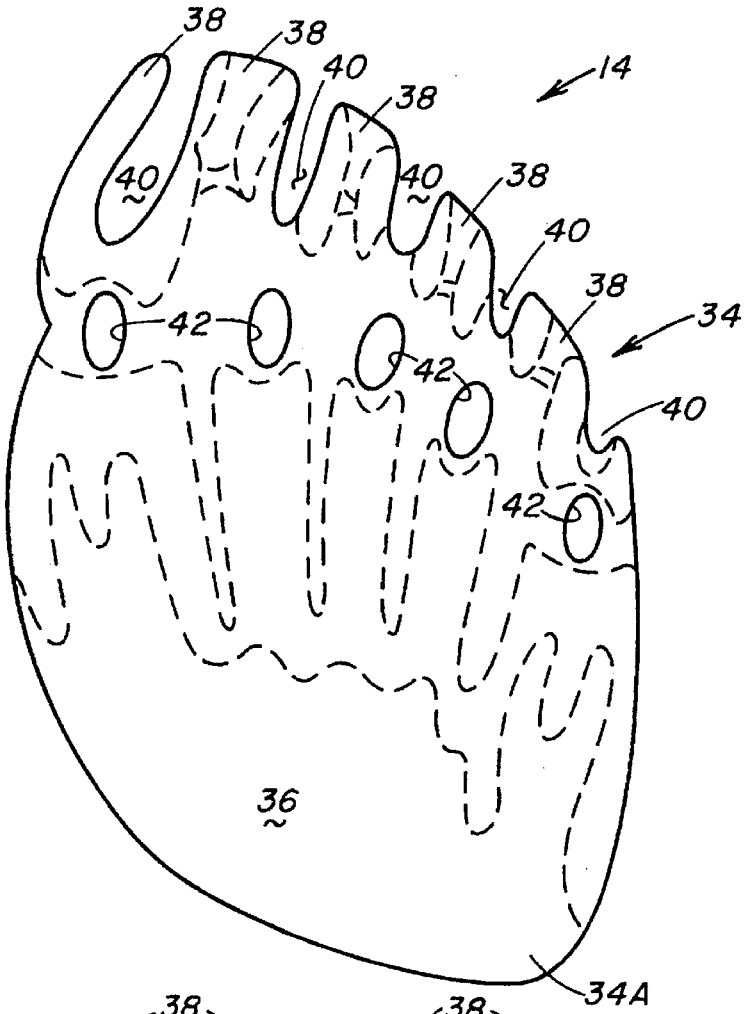
FIG. 3 is a bottom plan view of a layer of resilient elastic material of the sculptured sole of FIG. 1.
Figure 6:
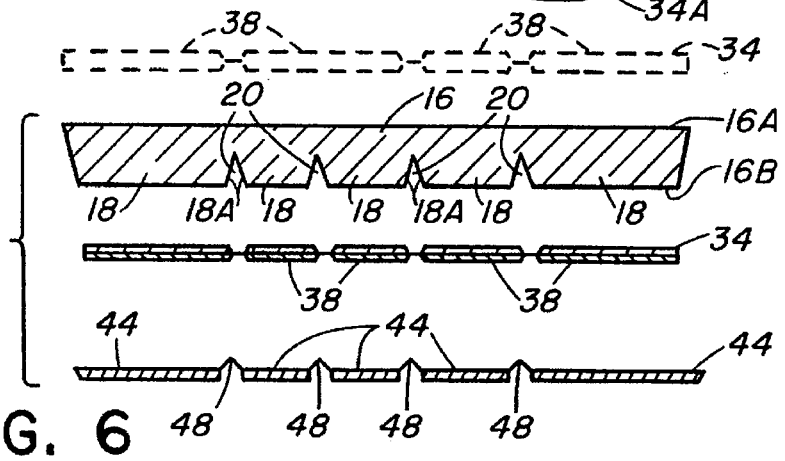
FIG. 6 is an exploded cross-sectional view of support pads, elastic layer and the plates of the sculptured sole taken along line 6—6 in FIG. 1.
Figure 7:
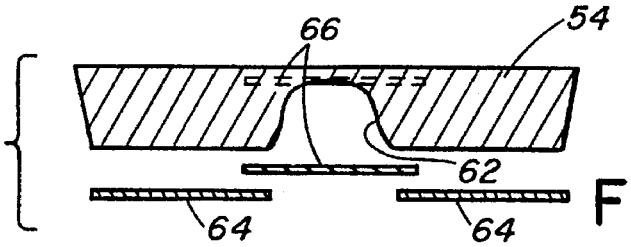
FIG. 7 is an exploded cross-sectional view of the heel member of the sculptured sole taken along line 7—7 in FIG. 1.
Figure 4:
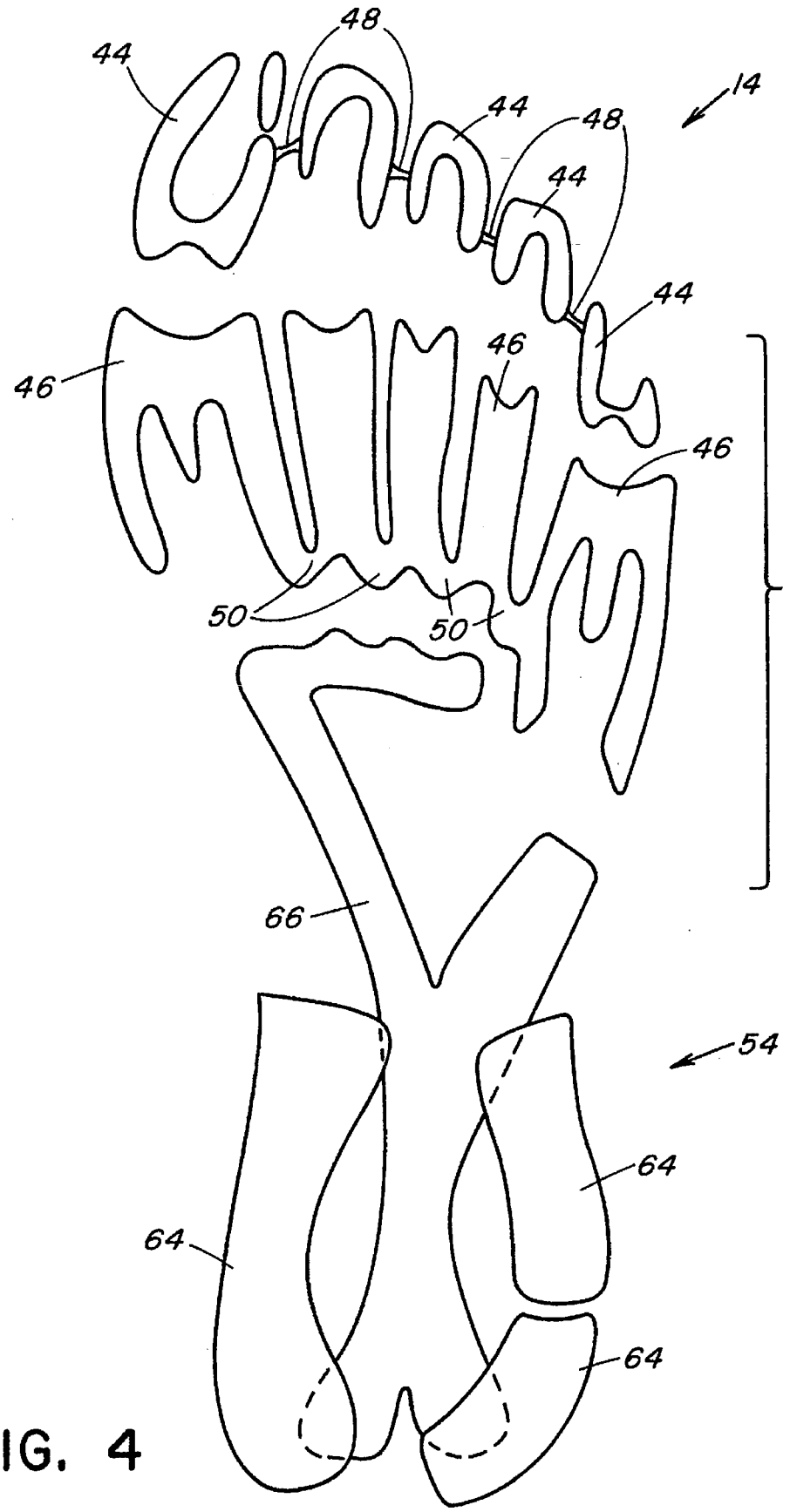
FIG. 4 is a bottom plan view of the plates and caps of the sculptured sole of the FIG. 1.
Figure 5:
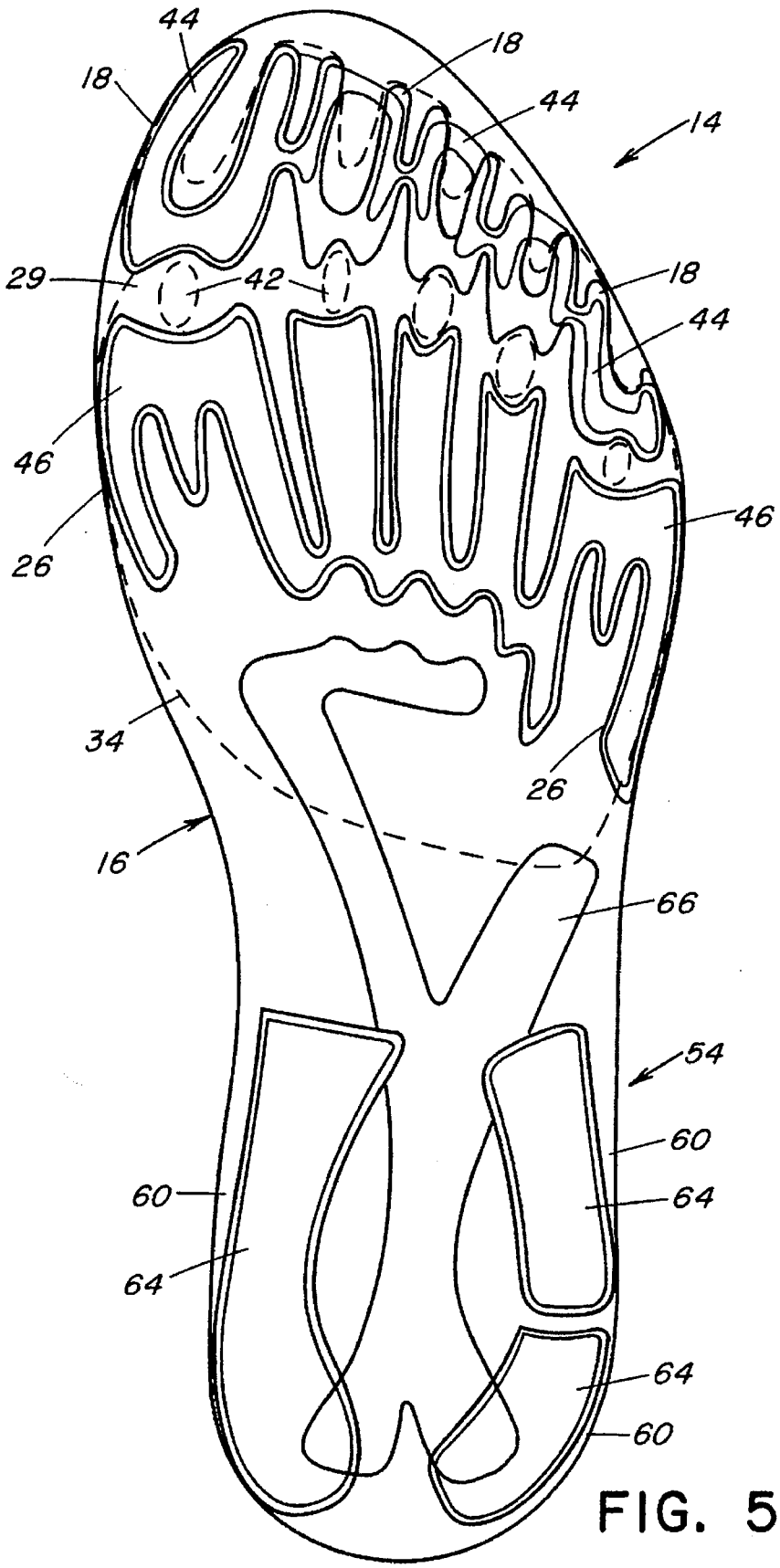
FIG. 5 is an assembled bottom plan view of the sculptured sole of FIG. 1.

Referring to FIGS. 1, 2, 5 and 6, the sculptured sole 14 of the present invention basically includes a base 16 of resiliently compressible material, such as polyurethane or compessed EVA, having opposite top and bottom sides 16A, 16B and opposite forward and rearward edges 16C, 16D, a plurality of forward support pads 18 each having an outer substantially flat face and being defined on the bottom side 16B of the base 16, and a plurality of separation grooves 20 defined in the bottom side 16B of the base 16 so as to extend between and space apart adjacent ones of the respective support pads 18. As shown in FIG. 6, preferably, the grooves 20 are V-shaped in cross-section. The support pads 18 so formed extend downwardly from the base 16 with the opposite sides 18A of the support pads 18 converging slightly toward one another. The support pads 18 also extend rearwardly from the forward edge 16C of the base 16 so that each support pad 18 will underlie only one of the toes of the wearer's foot disposed above the sculptured sole 14. Also, a plurality of slots 22 are defined in the bottom side 16B of the base 16 such that each slot 22 is formed centrally of one of the forward support pads 18. Each slot 22 has an open front end 22A adjacent to the forward edge 16C of the base 16 and a closed rear end 22B spaced rearwardly from the forward end 16C of the base 16. Thus, as shown in FIG. 2, each support pads 18 has a generally U-shaped configuration. The support pads 18 can be integrally connected with the base 16 or be separate parts which are bonded thereto.

Further, the slots 22 in the support pads 18 extend generally in alignment with the respective toes of the wearer's foot, whereas the separation grooves 20 between the support pads 18 extend generally in alignment with the respective gaps between the toes. Forces applied to the support pads 18 by the respective toes, during the transition of the "on the ground" foot from the mid stance phase to the toe off phase of a typical walking and running gait, are directed toward the respective slots 22 centrally formed therein. The grooves 20 extending between the toes of the wearer's foot isolate the support pads 18 from one another so that each support pad 18 undergoes compression and rebound substantially in response to the force applied thereto and lifted therefrom only by the respective one of the toes of the foot aligned with the support pad 18. Also, each support pad 18 has a rear end 18B facing away from the forward end 16C of the base 16. The rear end 18B of the support pad 18 has a concave or arcuate-shaped recess 24 formed therein in aligment with and spaced rearwardly from the closed rear end 22B of the slot 22. The arcuate-shaped recess 24 is adapted to align the force applied to the support pad 18 with the slot 22 therein so as to control and focus the energy of the foot in the desired forward direction for the toe off phase of the "on the ground" foot movement.

The sculptured sole 14 of the present invention further includes a plurality of rearward support lands 26 each having an outer substantially flat face and being defined on the bottom side 16B of the base 16, and a plurality of separation channels 28 defined in the bottom side 16B of the base 16 so as to extend between and space apart adjacent ones of the respective support lands 26. Similarly to the grooves 20 between the forward support pads 18, the channels 28 are V-shaped in cross-section. The support lands 26 so formed extend downwardly from the base 16 with the opposite sides 26A of the support lands 26 converging slightly toward one another. The support lands 26 also are spaced rearwardly by a generally transversely-extending arcuate-shaped depression 29 from the forward support pads 18 and extend rearwardly therefrom such that each support land 26 underlies a respective one of the metatarsels of the wearer's foot disposed above the sculptured sole 14. The separation channels 28 between the support lands 26 extend generally in alignment with the respective gaps between the toes. Forces applied to the support lands 26 by the respective toes, during the transition of the "on the ground" foot from the mid stance phase to the toe off phase of a typical walking and running gait, are directed along the respective support lands 26. The channels 28 extending between the metatarsels of the weareris foot isolate the support lands 26 from one another so that each support land 26 undergoes compression and rebound substantially in response to the force applied thereto and lifted therefrom only by the respective one of the metatarsels of the foot aligned with the support land 26. Also, each support land 26 has opposite front and rear ends 26A, 26B with respective concave or arcuate-shaped recesses 30, 32 formed therein, which align the force applied to the rearward support land 26 with the arcuate-shaped recesses 24 and slots 22 in the forward support pad 18 so as to control and focus the energy of the foot in the desired forward direction for the toe off phase of the "on the ground" foot movement. The support lands 26 can be integrally connected with the base 16 or be separate parts which are bonded thereto. Referring to FIGS. 1, 3, 5 and 6, the sculptured sole 14 of the present invention further includes a layer 34 of resiliently elastic material, such as latex or neoprene, attached to one of the top and bottom sides 16A, 16B of the base 16. Preferably, the layer 34 is disposed below and attached to the bottom side 16B of the base 16, as shown in exploded solid line form in FIG. 6. Alternatively, it can be applied upon the top side 16A, as shown in exploded dashed line form in FIG. 6. The layer 34 has a main portion 36 for overlying and extending generally in alignment with the rearward support lands 26, and a plurality of edge portions 38 extending forwardly from the main portion 36. Each of the edge portions 38 extends generally coextensive and is aligned with a respective one of the forward support pads 18 on the base 16 and with the slot 22 formed centrally of the one support pad 18. The layer 34 also has a plurality of openings 40 formed through the main portion 36, extending generally in alignment with the grooves 30 in the base 16 and between and spacing apart adjacent ones of the edge portions 38 of the layer 34 such that each edge portion 38 is isolated from one another so as to stretch and store energy as the aligned one forward support pad 18 undergoes compression and to contract and release energy as the one forward support pad 18 undergoes rebound substantially in response to the force applied thereto and lifted therefrom only by the respective one of the wearer's toes. The layer 34 further has a plurality of holes 42 formed through the main portion 36 thereof extending generally in alignment with and disposed forwardly of forward ends 26B of the support lands 26 such that the main portion 36 of the layer 34 is adapted to stretch and store energy as the support lands 26 undergo compression and to contract and release energy as the support lands 26 undergo rebound substantially in response to the force applied thereto and lifted therefrom by respective ones of the metatarsals of the wearer's foot.

Referring to FIGS. 1 and 4–6, the sculptured sole 14 of the present invention still further includes a plurality of substantially flat plates 44 and a plurality of substantially flat caps 46, both being made of a suitable flexible inelastic material, such as a suitable plastic, graphite or fiberboard material. Each plate 44 is spaced apart from one another and attached in any suitable manner on the layer 34 generally in alignment with a respective one of the forward support pads 18 of the base 16. A plurality of webs 48 made of flexible inelastic material extends between and interconnects adjacent ones of the plates 44. Each cap 46 is spaced apart from one another and attached in any suitable manner on the layer 34. Each cap 46 is also spaced rearwardly from a respective one of the plates 44 and disposed generally in alignment with a respective one of the rearward support lands 26 of the base 16. A plurality of webs 50 made of flexible inelastic material extend between and interconnect adjacent ones of the caps 46. The webs 48, 50 permit the provision of the pluralities of plates 44 and caps 46 as respective one-piece components which facilitates the ease of handling thereof and their application on the layer 34. The layer 34 also has a top surface 34A with a pattern imprinted thereon in a configuration generally matching that of the plates 44 and caps 46 for ease of locating the plates and caps at the respective correct positions thereon. Each of the plates 44 is generally U-shaped and has a cutout 52 defined centrally therein. At least some of the plates 44 have an end 44A closing an end of the cutout 52 and disposed adjacent to the forward edge 16C of the base 16 so as to extend across and bridge the front open end 22A of the slot 22 centrally formed in each of the support pads 18.

Finally, referring to FIGS. 1–3 and 7, the sculptured sole 14 of the present invention includes a heel member 54 made of a resiliently compressible material, such as polyurethane or compressed EVA, and attached to the base 16 and extending rearwardly therefrom. The heel member 54 includes a rear end section 56 defining a transversely-extending rearwardly and upwardly inclined rear bevel surface 58, and a pair of opposite side support sections 60 merging with and extending forwardly from the rear end section 56 and defining therewith a longitudinal concavity 62 open at a rear end 62A through the rear bevel surface 58 and extending forwardly between the opposite side support sections 60 so as to direct forces of compression and rebound into the concavity 62 and thereby provide improved stability for and absorption of shock to a heel of the wearer's foot. Since the inclined rear bevel surface 58 of the rear end section 56 opens the longitudinal concavity 62 at the rear end of the heel member 54, the compression of the side support sections 60 into the void created by the concavity 62 is not inhibited. The sculptured sole 14 of the present invention also includes heel plates 64 and a central heel fork 66 which overlie and are applied to the heel member 54.

The aforementioned components of the sculptured sole 14 of the present invention address the needs of the wearer's foot and ankle system during the three successive basic phases of a typical walking or running gait: heel strike, mid stance and toe off. At heel strike, the heel plates 64 and heel fork 66 tend to help stabilize and hold or reduce the rear-foot from over-supination or over-pronation by guiding and stabilizing the cal caneus or heel bone. Then, after heel strike, the long heel fork 66 helps to hasten "lock up" of the mid-foot while the support pads 18 and lands 26 and the plates 44 and caps 46 guide transition of the fore-foot through mid stance to toe off which propels the foot into a final push off lever which provides more power.

The support pads 18 and lands 26 of the sculptured sole 14 have flat outer faces with downwardly sloping sides which allow the material thereof to compress in upon itself. The substantial height or thickness of the support pads 18 and lands 26 increases the time taken to compress the material thereof which gives the neuromuscular system of the wearer more time to transfer energy, resulting in less trauma of the foot and more control of foot motion.

The resilient elastic layer 34 of the sculptured sole 14 acts like foot musculature. It absorbs and releases energy. The isolated support pads 18 and lands 26 together with their respective plates 44 and caps and the presence of the elastic layer 34 reduce the torques caused by the "piano keying" effects of the metatarsals during the loading of the fore-foot and allow greater flexion and levering of the toes for the final power off of the foot. Each foot is inherently different in the degree to which it is misaligned from a desired neutral alignment. The above-described parts of the sculptured sole 14 tend to brace and equalize these different misalignments. Energy storage occurs as the layer 34 is stretched between the pads 18 and lands 26 during mid stance or forward roll. Energy is released at toe off increasing forward propulsion. The raised imprint of the plates 44 and caps 46 on the surface of the layer 34 assists in their location and securement on the layer 34.

The plates 44 and caps 46 of the sculptured sole 14 can be sandwiched anywhere in the shoe strata, such as, between the foot and insole, the insole and midsole, midsole and sole, or sole and ground. The plates 44 and caps 46 provide control and initiate compression of the support pads 18 and lands 26 and stretch of the layer 34. The plates 44 and caps 46 predictably initiate compression so that the sole 14 can be designed to take maximum advantage of the absorbing, storing and transferring of the forces of the impact, changing it from potential to kinetic energy.

In summary, the system of components of the sculptured sole 14 disclosed herein can be varied in configuration and thickness within the purview of the principles of the present invention so as to permit "tuning" of footwear to the particular activity of the wearer so that performance of the wearer in the particular activity is enhanced while the potential for injury is reduced. The system of components provide footwear incorporating the sculptured sole 14 to have a controlled barefoot running effect which should tend to strengthen the foot as opposed to restrict natural movement as in the case of many current designs. In faster paced running, the components of the sculptured sole 14 will add speed and improve alignment when the foot hits more in the mid stance phase and then quickly toes off.

While the present invention has been described as a sole for use in construction of a shoe, it equally applies where the sole of the present invention is used as an insole or sock liner.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A sculptured sole for use in construction of a shoe, said sole comprising:

(a) a base of resiliently compressible material having opposite top and bottom sides and opposite forward and rearward edges;

(b) a plurality of support pads defined on said bottom side of said base so as to extend downwardly from said bottom side thereof and rearwardly from said forward edge thereof, each of said support pads underlying a respective one of a plurality of toes of a foot wearing a shoe incorporating said sole and being disposed above said sole;

(c) said base having a plurality of slots formed in said bottom side of said base, each slot being formed centrally of one of said support pads so as to extend generally in alignment with the respective one toe said one support pad underlies such that a force applied to said one support pad by the respective one of the toes is directed toward said respective slot centrally formed therein;

(d) said base further having a plurality of grooves formed in said bottom side of said base, said grooves being formed between and spacing apart adjacent ones of said support pads and extending generally in alignment with respective gaps between the toes of the foot and isolating said support pads from one another such that each said support pad undergoes compression and rebound substantially in response to the force applied thereto and lifted therefrom only by the respective one of the toes of the foot; and (e) a layer of resiliently elastic material attached to one of said top and bottom sides of said base, said layer having a main portion, a plurality of edge portions extending from said main portion, each of said edge portions being generally coextensive and aligned with one of said support pads of said base and aligned with said slot formed centrally of said one support pad, and means defining a plurality of openings through said main portion extending generally in alignment with said grooves in said base and between and spacing apart adjacent ones of said edge portions of said layer such that each of said edge portions of said layer is isolated from one another so as to stretch and store energy as said aligned one support pad undergoes compression and to contract and release energy as said one support pad undergoes rebound substantially in response to the force applied thereto and lifted therefrom only by the respective one of the toes of the foot.

2. The sole of claim 1 wherein each of said support pads has a rear end facing toward said rearward end of said base, said rear end of each said support pad having an arcuate shaped recess formed therein in aligment with said slot and being adapted to direct the force applied to said support pad in alignment with said slot.

3. The sole of claim 1 further comprising:

(f) a plurality of generally flat plates made of a flexible inelastic material, each of said plates being spaced apart from one another and attached on said layer of resiliently elastic material and disposed generally in alignment with a respective one of said support pads of said base.

4. The sole of claim 3 wherein said layer also includes a surface having a pattern imprinted thereon of a configuration generally matching that of said plates for locating the respective positions of said plates on said layer.

5. The sole of claim 3 wherein each of said support pads of said base is generally U-shaped with said slot centrally formed therein having an open end adjacent to said front edge of said base.

6. The sole of claim 5 wherein each of said plates is generally U-shaped and has a cutout defined centrally therein, at least some of said plates having an end closing said cutout and disposed adjacent to said front edge of said base so as to extend across said open end of said slot centrally formed in each of said U-shaped support pads.

7. A sculptured sole for use in construction of a shoe, said sole comprising:

(a) a base of resiliently compressible material having opposite top and bottom sides and opposite forward and rearward edges;

(b) a plurality of support pads defined on said bottom side of said base so as to extend downwardly from said bottom side thereof and rearwardly from said forward edge thereof, each of said support pads underlying a respective one of a plurality of toes of a foot wearing a shoe incorporating said sole and being disposed above said sole;

(c) said base having a plurality of slots formed in said bottom side of said base, each slot being formed centrally of one of said support pads so as to extend generally in alignment with the respective one toe said one support pad underlies such that a force applied to said one support pad by the respective one of the toes is directed toward said respective slot centrally formed therein;

(d) said base further having a plurality of grooves formed in said bottom side of said base, said grooves being formed between and spacing apart adjacent ones of said support pads and extending generally in alignment with respective gaps between the toes of the foot and isolating said support pads from one another such that each said support pad undergoes compression and rebound substantially in response to the force applied thereto and lifted therefrom only by the respective one of the toes of the foot; and (e) a plurality of generally flat plates made of a flexible inelastic material, each of said plates being spaced apart from one another and applied on said base and disposed generally in alignment with a respective one of said support pads of said base, wherein each of said plates is generally U-shaped and has a cutout defined centrally therein and a front end closing said cutout and disposed adjacent to said front edge of said base so as to extend across said slot centrally formed in each of said support pads.

8. The sole of claim 7 further comprising:

(g) a plurality of webs made of flexible inelastic material, each of said webs extending between and interconnecting adjacent ones of said plates.

9. The sole of claim 7 further comprising:

(e) a heel member made of a resiliently compressible material and being attached to said base and extending rearwardly therefrom, said heel member including (i) a rear end section defining a transversely-extending rearwardly and upwardly inclined rear bevel surface, and (ii) a pair of opposite side support sections merging with and extending forwardly from said rear end section and defining therewith a longitudinal concavity open at a rear end through said rear bevel surface and extending forwardly between said opposite side support sections so as to direct forces of compression and rebound into said concavity and thereby provide stability for and absorption of shock to a heel of the foot wearing the shoe incorporating said sole.

10. The sole of claim 9 further comprising:

(f) a pair of heel plates and a central heel fork overlying and applied to the heel member.

11. A sculptured sole for use in construction of a shoe, said sole comprising:

(a) a base of resiliently compressible material and having opposite top and bottom sides and opposite forward and rearward edges;

(b) a plurality of support lands defined on said bottom side of said base so as to extend downwardly from said bottom side thereof and rearwardly spaced from said forward edge thereof, each of said support lands underlying a respective one of a plurality of metatarsels of a foot wearing a shoe incorporating said sole and being disposed above said sole;

(c) said base having a plurality of channels formed in said bottom side of said base, said channels being formed between and spacing apart adjacent ones of said support lands and extending generally in alignment with respective gaps between the metatarsels of the foot and isolating said support lands from one another such that each of said support land undergoes compression and rebound substantially in response to the force applied thereto and lifted therefrom only by the respective one of the metatarsels of the foot; and (d) a layer of resiliently elastic material attached to one of said top and bottom sides of said base, said layer having a main portion and means defining a plurality of holes through said main portion extending generally in alignment with and disposed forwardly of forward ends of said support lands such that main portion of said layer is adapted to stretch and store energy as said support lands undergo compression and to contract and release energy as said support lands undergo rebound substantially in response to the force applied thereto and lifted therefrom by respective ones of the metatrasals of the foot.

12. The sole of claim 11 wherein each of said support lands has a front end facing toward said forward end of said base, said front end of each said support land having an arcuate shaped recess formed therein in aligment with said holes in said layer.

13. The sole of claim 11 further comprising:

(e) a plurality of caps made of a flexible inelastic material, each of said caps being spaced apart from one another and attached on said layer of resiliently elastic material and disposed generally in alignment with a respective one of said support lands of said base.

14. The sole of claim 13 wherein said layer also includes a surface having a pattern imprinted thereon of a configuration generally matching that of said caps for locating the respective positions of said caps on said layer.

15. A sculptured sole for use in construction of a shoe, said sole comprising:

(a) a base of resiliently compressible material and having opposite top and bottom sides and opposite forward and rearward edges;

(b) a plurality of support lands defined on said bottom side of said base so as to extend downwardly from said bottom side thereof and rearwardly spaced from said forward edge thereof, each of said support lands underlying a respective one of a plurality of metatarsels of a foot wearing a shoe incorporating said sole and being disposed above said sole;

(c) said base having a plurality of channels formed in said bottom side of said base, said channels being formed between and spacing apart adjacent ones of said support lands and extending generally in alignment with respective gaps between the metatarsels of the foot and isolating said support lands from one another such that each of said support land undergoes compression and rebound substantially in response to the force applied thereto and lifted therefrom only by the respective one of the metatarsels of the foot; and (d) a plurality of caps made of a flexible inelastic material, each of said caps being spaced apart from one another and attached on said layer of resiliently elastic material and disposed generally in alignment with a respective one of said support lands of said base, wherein at least some of said caps are generally U-shaped and have a cutout defined centrally therein and a front end closing said cutout.

16. The sole of claim 15 further comprising:

(f) a plurality of webs made of flexible inelastic material, each of said webs extending between and interconnecting adjacent ones of said caps.

17. The sole of claim 15 further comprising:

(e) a heel member made of a resiliently compressible material and being attached to said base and extending rearwardly therefrom, said heel member including (i) a rear end section defining a transversely-extending rearwardly and upwardly inclined rear bevel surface, and (ii) a pair of opposite side support sections merging with and extending forwardly from said rear end section and defining therewith a longitudinal concavity open at a rear end through said rear bevel surface and extending forwardly between said opposite side support sections so as to direct forces of compression and rebound into said concavity and thereby provide stability for and absorption of shock to a heel of the foot wearing the shoe incorporating said sole.

18. The sole of claim 17 further comprising:

(f) a pair of heel plates and a central heel fork overlying and applied to the heel member.

19. A sculptured sole for use in construction of a shoe, said sole comprising:

(a) a base of resiliently compressible material and having opposite top and bottom sides and opposite forward and rearward edges;

(b) a plurality of forward support pads defined on said bottom side of said base so as to extend downwardly from said bottom side thereof and rearwardly from said front edge thereof, each of said forward support pads underlying a respective one of a plurality of toes of a foot wearing a shoe incorporating said sole and being disposed above said sole;

(c) said base having a plurality of slots formed in said bottom side of said base, each slot being formed centrally of one of said forward support pads so as to extend generally in alignment with the respective one toe said one forward support pad underlies such that a force applied to said one forward support pad by the respective one of the toes is directed toward said respective slot centrally formed therein;

(d) said base further having a plurality of grooves formed in said bottom side of said base, said grooves being formed between and spacing apart adjacent ones of said forward support pads and extending generally in alignment with respective gaps between the toes of the foot and isolating said forward support pads from one another such that each said forward support pad undergoes compression and rebound substantially in response to the force applied thereto and lifted therefrom only by the respective one of the toes of the foot;

(e) a plurality of rearward support lands defined on said bottom side of said base so as to extend downwardly from said bottom side thereof and rearwardly spaced from said forward support pads and said forward edge of said base, each of said rearward support lands underlying a respective one of a plurality of metatarsels of a foot wearing a shoe incorporating said sole and being disposed above said sole;

(f) said base further having a plurality of channels formed in said bottom side of said base, said channels being formed between and spacing apart adjacent ones of said rearward support lands and extending generally in alignment with respective gaps between the metatarsels of the foot and isolating said rearward support lands from one another such that each of said rearward support land undergoes compression and rebound substantially in response to the force applied thereto and lifted therefrom only by the respective one of the metatarsels of the foot; and (g) a layer of resiliently elastic material attached to one of said top and bottom sides of said base, said layer having a main portion extending generally in alignment with said rearward support lands, a plurality of edge portions extending from said main portion, each of said edge portions being generally coextensive and aligned with one of said forward support pads of said base and aligned with said slot formed centrally of said one support pad, means defining a plurality of openings through said main portion extending generally in alignment with said grooves in said base and between and spacing apart adjacent ones of said edge portions of said sheet such that each of said edge portions of said layer is isolated from one another so as to stretch and store energy as said aligned one forward support pad undergoes compression and to contract and release energy as said one forward support pad undergoes rebound substantially in response to the force applied thereto and lifted therefrom only by the respective one of the toes of the foot and means defining a plurality of holes through said main portion extending generally in alignment with and disposed forwardly of forward ends of said support lands such that main portion of said layer is adapted to stretch and store energy as said rearward support lands undergo compression and to contract and release energy as said rearward support lands undergo rebound substantially in response to the force applied thereto and lifted therefrom by respective ones of the metatrasals of the foot.

20. The sole of claim 19 further comprising:

(h) a plurality of plates made of a flexible inelastic material, each of said plates being spaced apart from one another and attached on said layer of resiliently elastic material and disposed generally in alignment with a respective one of said forward support pads of said base.

21. The sole of claim 19 further comprising:

(i) a plurality of caps made of a flexible inelastic material, each of said caps being spaced apart from one another and attached on said layer of resiliently elastic material and disposed generally in alignment with a respective one of said rearward support lands of said base.

22. A sculptured sole for use in construction of a shoe, said sole comprising:

(a) a base of resiliently compressible material and having opposite top and bottom sides and opposite forward and rearward edges;

(b) a plurality of forward support pads defined on said bottom side of said base so as to extend downwardly from said bottom side thereof and rearwardly from said front edge thereof, each of said forward support pads underlying a respective one of a plurality of toes of a foot wearing a shoe incorporating said sole and being disposed above said sole;

(c) said base having a plurality of slots formed in said bottom side of said base, each slot being formed centrally of one of said forward support pads so as to extend generally in alignment with the respective one toe said one forward support pad underlies such that a force applied to said one forward support pad by the respective one of the toes is directed toward said respective slot centrally formed therein;

(d) said base further havingq a plurality of grooves formed in said bottom side of said base, said grooves being formed between and spacing apart adjacent ones of said forward support pads and extending generally in alignment with respective gaps between the toes of the foot and isolating said forward support pads from one another such that each said forward support pad undergoes compression and rebound substantially in response to the force applied thereto and lifted therefrom only by the respective one of the toes of the foot;

(e) a plurality of rearward support lands defined on said bottom side of said base so as to extend downwardly from said bottom side thereof and rearwardly spaced from said forward support pads and said forward edge of said base, each of said rearward support lands underlying a respective one of a plurality of metatarsels of a foot wearing a shoe incorporating said sole and being disposed above said sole;

(f) said base further having a plurality of channels formed in said bottom side of said base, said channels being formed between and spacing apart adjacent ones of said rearward support lands and extending gqenerally in alignment with respective gaps between the metatarsels of the foot and isolating said rearward support lands from one another such that each of said rearward support land undergoes compression and rebound substantially in response to the force applied thereto and lifted therefrom only by the respective one of the metatarsels of the foot;

(g) a plurality of plates made of a flexible inelastic material, each of said plates being spaced apart from one another and applied on said base and disposed generally in alignment with a respective one of said forward support pads of said base;

(h) a plurality of first webs made of flexible inelastic material, each of said first webs extending between and interconnecting adjacent ones of said plates;

(i) a plurality of caps made of a flexible inelastic material, each of said caps being spaced apart from one another and applied on said base and disposed generally in alignment with a respective one of said rearward support lands of said base; and (j) a plurality of second webs made of flexible inelastic material, each of said second webs extending between and interconnecting adjacent ones of said caps.

23. The sole of claim 22 further comprising:

(k) a heel member made of a resiliently compressible material and being attached to said base and extending rearwardly therefrom, said heel member including (i) a rear end section defining a transversely-extending rearwardly and upwardly inclined rear bevel surface, and (ii) a pair of opposite side support sections merging with and extending forwardly from said rear end section and defining therewith a longitudinal concavity open at a rear end through said rear bevel surface and extending forwardly between said opposite side support sections so as to direct forces of compression and rebound into said concavity and thereby provide stability for and absorption of shock to a heel of the foot wearing the shoe incorporating said sole.

24. A sole component for use in a shoe, said sole component comprising:

(a) a plurality of generally flat plates made of a flexible inelastic material, each of said plates being spaced apart from one another for placing said plates in general alignment with respective ones of a plurality of toes of a foot wearing a shoe incorporating said sole component, each of said plates being generally U-shaped and having a cutout defined centrally therein for alignment with a respective one of the toes of the foot, at least some of said plates having a front end closing said cutout; and (b) a plurality of webs made of flexible inelastic material, each of said webs extending between and interconnecting adjacent ones of said plates.

25. A sole component for use in a shoe, said sole component comprising:

(a) a plurality of caps made of a flexible inelastic material, each of said caps being spaced apart from one another for placing said caps in general alignment with respective ones of a plurality of metatarsals of a foot wearing a shoe incorporating said sole component, at least some of said caps being generally U-shaped and having a cutout defined centrally therein for alignment with a respective one of the metatarsals of the foot and a front end closing said cutout; and (b) a plurality of webs made of flexible inelastic material, each of said webs extending between and interconnecting adjacent ones of said caps.

* * * * *

UNITED STATES PATENT AND TRADEMARK OFFICE

CERTIFICATE OF CORRECTION

PATENT NO. : 5,647,145
DATED : July 15, 1997
INVENTOR(S) : Brian Russell

It is certified that error appears in the above-identified patent and that said Letters Patent is hereby corrected as shown below:

On the title page, Item [76], please delete:
"; Danny Abshire of 633D S. Broadway, Boulder, Colo. 80303".

Signed and Sealed this

Thirteenth Day of February, 2001

*Attest:*

Nicholas P. Godici

NICHOLAS P. GODICI

*Attesting Officer*

*Acting Director of the United States Patent and Trademark Office*